US007128125B2

(12) United States Patent
Harbison

(10) Patent No.: US 7,128,125 B2
(45) Date of Patent: Oct. 31, 2006

(54) DURABLE SEALING CURTAIN

(76) Inventor: Charles Harbison, 156 Crooked Creek Rd., Alexander City, AL (US) 35010

( * ) Notice: Subject to any disclaimer, the term of this patent is extended or adjusted under 35 U.S.C. 154(b) by 318 days.

(21) Appl. No.: 10/796,443

(22) Filed: Mar. 9, 2004

(65) Prior Publication Data

US 2006/0137836 A1 Jun. 29, 2006

(51) Int. Cl.
*A47G 5/02* (2006.01)

(52) U.S. Cl. ..... 160/273.1; 160/277; 160/194

(58) Field of Classification Search ..... 160/273.1, 160/277, 268.1, 194, 271, 272
See application file for complete search history.

(56) References Cited

U.S. PATENT DOCUMENTS

| | | | | |
|---|---|---|---|---|
| 326,799 | A | 9/1885 | Snook et al. | |
| 669,967 | A | 3/1901 | Solomon | |
| 767,909 | A * | 8/1904 | MIller | 160/277 |
| 2,270,978 | A | 1/1942 | Swormstedt | |
| 2,325,992 | A | 8/1943 | Wirthman | |
| 2,350,288 | A * | 5/1944 | Michelman | 160/133 |
| 2,564,770 | A | 8/1951 | Spencer | |
| 3,017,927 | A | 10/1959 | Demko | |
| 3,034,575 | A * | 5/1962 | Stroup | 160/40 |
| 3,116,097 | A | 12/1963 | Novales | |
| 4,119,133 | A * | 10/1978 | Wolf | 160/209 |
| 4,237,956 | A * | 12/1980 | Sivin et al. | 160/120 |
| 4,333,511 | A | 6/1982 | Johnston | |
| 4,335,774 | A | 6/1982 | Price | |
| 4,649,981 | A | 3/1987 | Bibeau | |
| 4,880,046 | A * | 11/1989 | Gesy | 160/194 |
| 5,351,742 | A * | 10/1994 | Lichy | 160/273.1 |
| 5,566,736 | A | 10/1996 | Crider et al. | |
| 5,752,557 | A | 5/1998 | Crider et al. | |
| 5,785,105 | A | 7/1998 | Crider et al. | |
| 5,887,385 | A * | 3/1999 | Horner et al. | 49/26 |
| 5,960,847 | A | 10/1999 | Crider et al. | |
| 6,138,739 | A | 10/2000 | Crider et al. | |
| 6,209,614 | B1 | 4/2001 | Smoot | |
| 6,412,538 | B1 | 7/2002 | Welfonder | |
| 6,481,487 | B1 * | 11/2002 | Simon | 160/84.06 |
| 6,691,761 | B1 * | 2/2004 | Alkhoury et al. | 160/273.1 |

* cited by examiner

*Primary Examiner*—Blair M. Johnson
(74) *Attorney, Agent, or Firm*—Kenneth M. Bush; Bush IP Law Group, LLC

(57) ABSTRACT

A durable sealing curtain assembly preferably comprising a pair of tracks slidably attached to opposite sides of an opening such as a door or window, a curtain having its lateral edges engaged by the tracks, and spring systems attached to each track, whereby the spring systems urge the tracks outwardly to maintain the curtain taut yet allow the tracks to slide inwardly towards the center of the opening so that the curtain does not endure excessive pressure upon application of an external force. At least one track preferably also comprises a cam mechanism that is operative to urge the track inwardly to release tension from the curtain and thereby allow the curtain to be more easily raised or lowered, after which, the cam mechanism can be disengaged to allow the track to return to its outwardly biased position, thus returning the curtain to a taut condition.

15 Claims, 7 Drawing Sheets

DURABLE SEALING CURTAIN

FIELD OF THE INVENTION

The field of the invention relates to a curtain that forms a seal with the frame of an opening such as a window or door as the curtain is urged across that opening. The curtain is durable so that it is able to withstand substantial external pressure without breakage.

BACKGROUND OF THE INVENTION

The use of sealed curtains is known in the prior art. Generally, a sealed curtain apparatus comprises a curtain and tracks along the frame of an opening such as a door or window. The edges of the curtain are engaged by the tracks. As the curtain is moved towards a position covering the opening, the edges of the curtain travel along the tracks. The benefit of this design is that the sealed curtain prevents matter such as insects and debris from passing through the space between the curtain and the frame. However, because the curtain is sealed, the apparatus becomes less durable because it cannot yield to external forces. With unsealed curtains, an external force applied to the curtain will merely briefly displace the curtain from the door or window frame. With sealed curtains, the engagement of the curtain edges with the tracks on the frame prevents the curtain from becoming displaced. Consequently, an external force applied to the sealed curtain may cause stress on the curtain leading to breakage.

In this respect, the durable sealing curtain according to the present invention substantially departs from the conventional concepts and designs of the prior art, and in so doing provides an apparatus which provides a seal between the edges of a curtain and the frame of an opening such as a door or window that is better able to withstand the application of substantial external forces without suffering failure of the apparatus.

Furthermore, in the prior art, the more tautly a sealed curtain is pulled across an opening, the more difficult it generally is to slide the curtain along the tracks. In this respect, the durable sealing curtain according to the present invention allows the curtain to be loosened while urged open or shut and then returned to a taut position when the curtain is in place.

SUMMARY OF THE INVENTION

In view of the foregoing disadvantages inherent in the known types of sealed curtains present in the prior art, the present invention provides an improved apparatus wherein the same is able to withstand the application of substantial external forces without suffering failure of the apparatus and provides a more easily slidable curtain that is still taut when the curtain is in place.

To attain this, the preferred embodiment of the present invention is a sealed curtain which preferably comprises a pair of tracks slidably attached to opposite sides of an opening such as a door or window, a curtain having edges engaged by the tracks, and spring systems attached to each track, whereby the spring systems urge the tracks outwardly to maintain the curtain taut yet allow the tracks to slide inwardly towards the center of the opening so that the curtain does not endure excessive pressure upon application of an external force. At least one track preferably also includes a cam mechanism that is operative to urge the track inwardly to decrease tension on the curtain and thereby allow the curtain to be more easily raised or lowered, after which, the cam mechanism can be disengaged to allow the track to return to its outwardly biased position, thus returning the curtain to a taut condition.

BRIEF DESCRIPTION OF THE DRAWINGS

The invention will be better understood when consideration is given to the following detailed description thereof. Such description makes reference to the annexed drawings wherein.

DETAILED DESCRIPTION OF THE PREFERRED EMBODIMENTS

Figure 1:
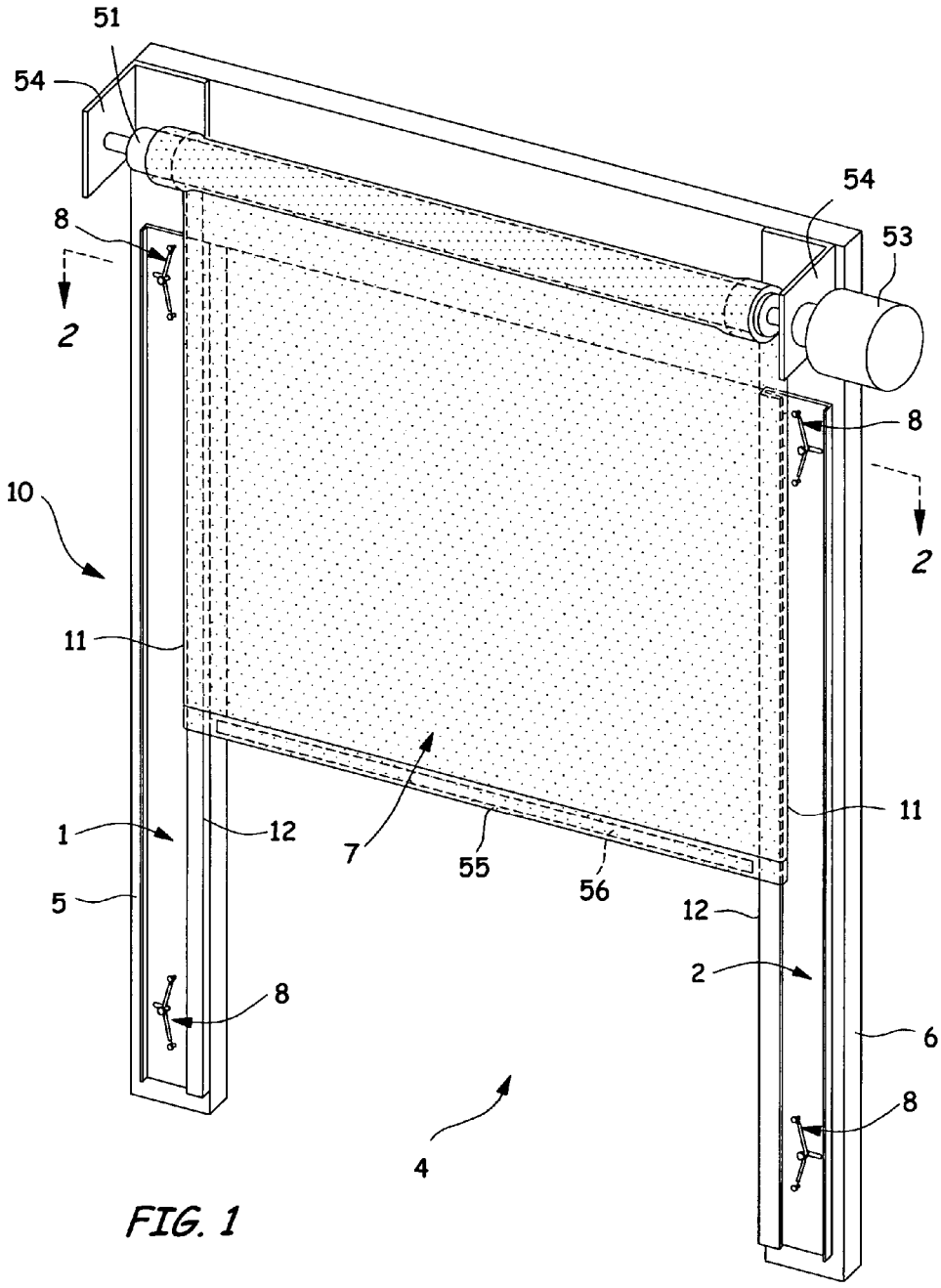
FIG. 1 is a perspective view of the preferred embodiment of the present invention.

The curtain apparatus is indicated generally by the numeral 10. The curtain apparatus 10 is designed to be attached to the frame of an opening 4 such as a door or window. However, the invention does not require the use of a pre-existing frame and could be practiced whereby the invention is incorporated into a prefabricated frame. The curtain apparatus 10 has a first track 1 and a second track 2. The first track 1 is slidably attached to a first frame member 5 of the opening 4. The second track 2 is slidably attached to a second frame member 6 of the opening 4. The curtain apparatus 10 has a curtain 7. The lateral edges 11 of the curtain 7 and the lateral edges 12 of the tracks 1, 2 are each shaped to allow the curtain edges to be engaged by the lateral edges of the tracks. This engagement is preferably accomplished with U-shaped or V-shaped curtain edges 11 and track edges 12. Where the curtain edges 11 are V-shaped, the apex of the curtain edges 11 are preferably heat sealed or hemmed. However, what is important is that the curtain edges 11 and track edges 12 are sufficiently engaged to prevent the curtain 7 from detaching from either track 1, 2. The curtain edges 11 are of sufficient rigidity so that they remain engaged by the track edges 12. The engagement of the curtain edges 11 by the track edges 12 allow the curtain 7 to be slidably engaged by the tracks 1, 2 so that the curtain 7 may be positioned at any location along the opening 4. The U-shaped or V-shaped fold in the curtain edges 11 remains present when the curtain 7 is rolled.

At any given position, the portion of the curtain 7 not covering the opening 4 is wound around a rotatable shaft 51. As the curtain 7 is urged to cover the opening 4, the shaft 51 rotates to unwind the curtain 7. As the curtain 7 is urged to uncover the opening 4, the shaft 51 rotates in an opposite direction to wind the curtain 7 around the shaft 51. Rotation of the shaft 51 is preferably controlled by a driving mechanism 53, which is preferably motorized. However, the driving mechanism 53 may be manually operated and also may include a counter spring. A bracket 54 is attached to each frame member 5, 6 to support the shaft 51. The curtain 7 has a leading edge 55 that preferably has a weighted member 56 hemmed therein.

Figure 9:
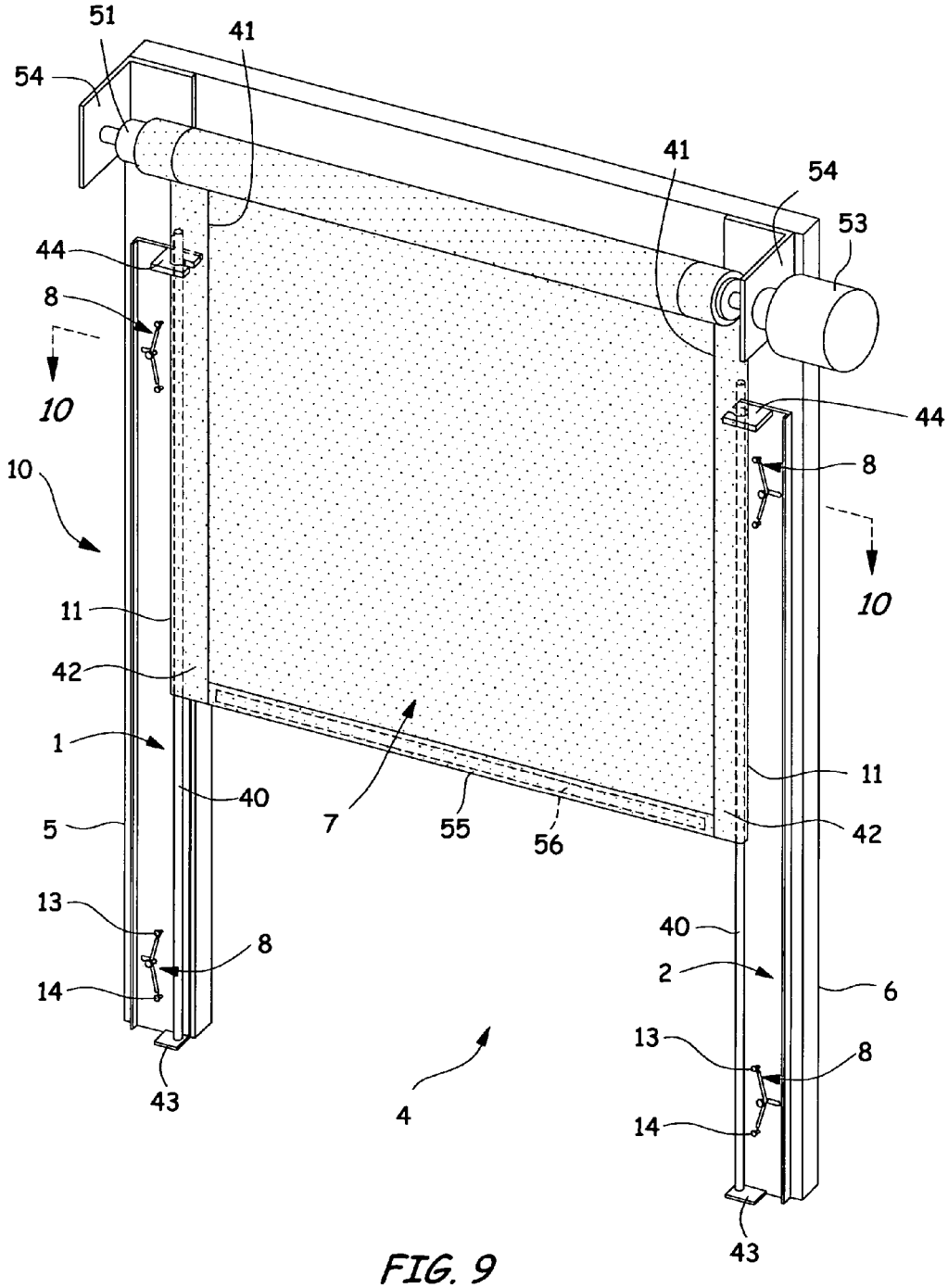
FIG. 9 is a perspective view of an alternate embodiment of the present invention comprising a rod attached to each track for engaging the edge of the curtain.
Figure 10A:
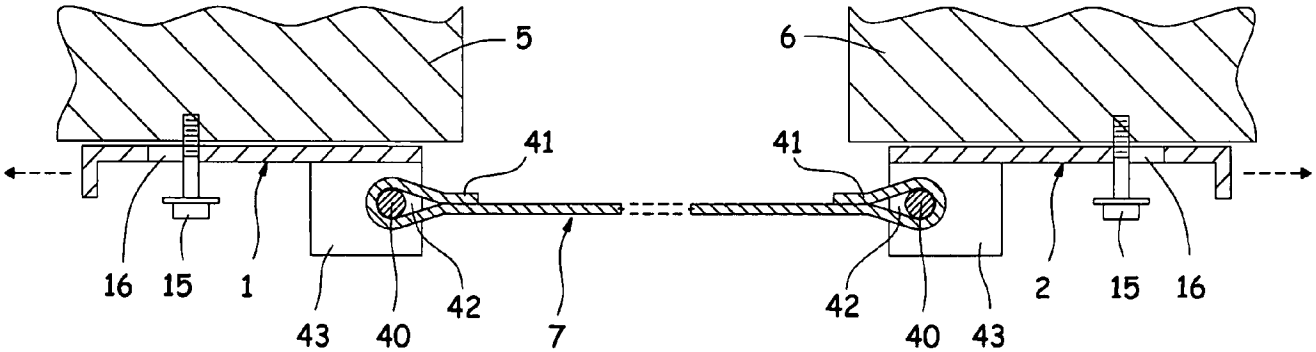
FIG. 10A is a sectional view of the embodiment of FIG. 9 taken along line 10—10 of FIG. 9.
Figure 10B:
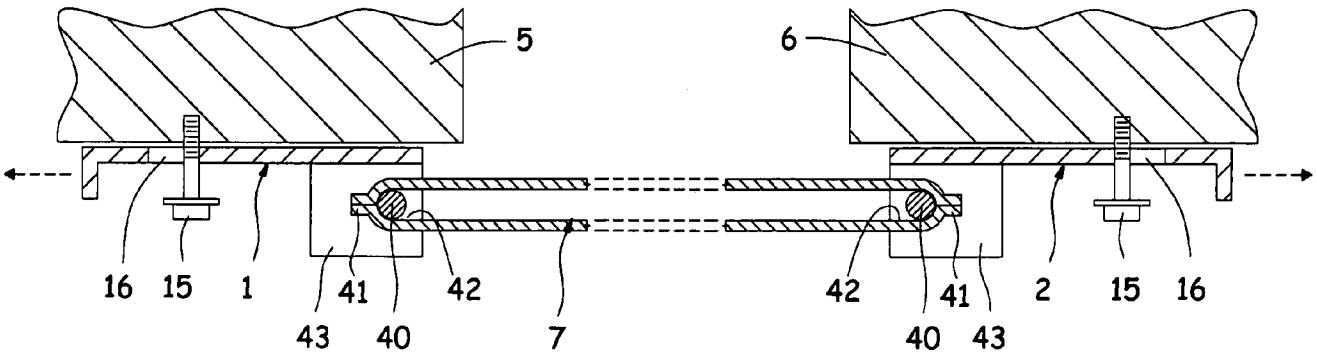
FIG. 10B is a sectional view of an alternate embodiment of the invention of FIG. 10A showing each hem of a multi-layered curtain located on the side of the rod opposite the opening.

In an alternate embodiment shown in FIGS. 9 and 10A, the tracks 1, 2 each have a rod 40 attached thereto. In this embodiment, each track 1, 2 preferably has an extension 43 at one end and a guide 44 at the opposite end. The lower end of the rod 40 is preferably fixedly attached to the rod extension 43. The rod guide 44 has an opening therethrough for receiving the upper end of the rod 40. Each lateral edge of the curtain 7 has a hem 41 forming an elongated channel 42 for slidably receiving a rod 40. In an alternate embodiment, the curtain may be multi-layered with a single channel along each lateral edge. The use of a multi-layered curtain allows air to become trapped between the layers so that the apparatus 10 may provide greater insulation. As best shown in FIG. 10B, this multi-layered curtain design may also be practiced whereby each hem 41 is located on the side of a rod 40 opposite the opening 4. Similarly, this design may also be practiced without hems 41 whereby the multi-layered curtain is comprised of a continuous material surrounding both rods 40.

Each track 1, 2 preferably has two spring mechanisms 8 that bias the track away from the opening 4, thereby keeping the curtain 7 taut. The spring mechanisms 8 allow the tracks 1, 2 to move inwardly towards the opening 4 in the event an external force is applied to the curtain 7, thus reducing the possibility of damage to the curtain 7. The spring mechanisms are preferably placed near the opposite ends of each track 1, 2. Each spring mechanism 8 preferably comprises a first post 13 and a second post 14, each fixedly attached to a track 1, 2. The first and second posts 13, 14 are preferably screws. The first post 13 and second post 14 are preferably positioned in such a manner whereby a line intersecting both posts 13, 14 would be substantially parallel to the line dividing the frame members 5, 6 and the opening 4. Approximately equidistant from the first post 13 and the second post 14 is a connecting member 15 that connects the tracks 1, 2 to the frame members 5, 6. The connecting member 15 is preferably on the opposite side of the line intersecting the first post 13 and the second post 14 from the opening 4. A horizontal slot 16 is cut into each track through which the connecting member 15 passes. The slot 16 allows the tracks 1, 2 to move relative to the connecting member 15 and thus relative to the frame members 5, 6. Consequently, when an external force is applied to the curtain 7, the slot 16 allows the tracks 1, 2 and curtain edges 11 to move inwardly so that the external force is not as likely to damage the curtain 7 or the seal of the edges 11. A spring 17 is preferably attached at its first end to the first post 13 and at its second end to the second post 14, therebetween engaging the connecting member 15 to bias the tracks 1, 2 away from the opening 4. The spring 17 can be a coil or any flexible, resilient member.

Figure 2:
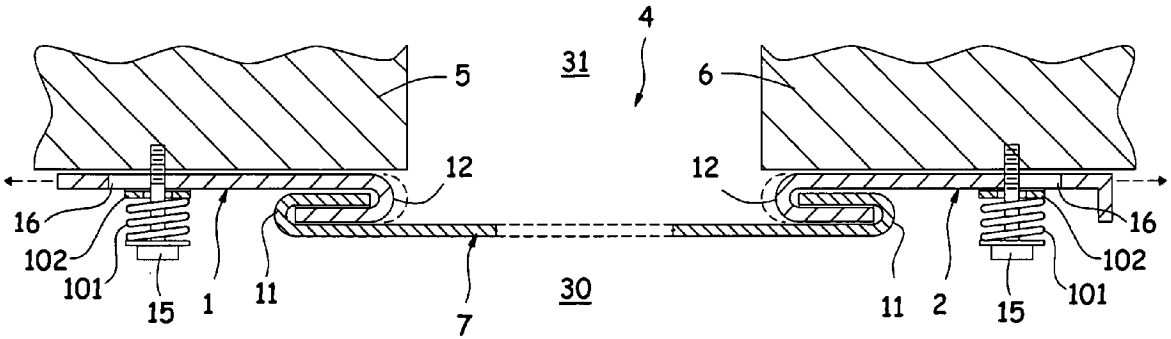
FIG. 2 is a sectional view of the preferred embodiment taken along line 2—2 of FIG. 1.
Figure 3:
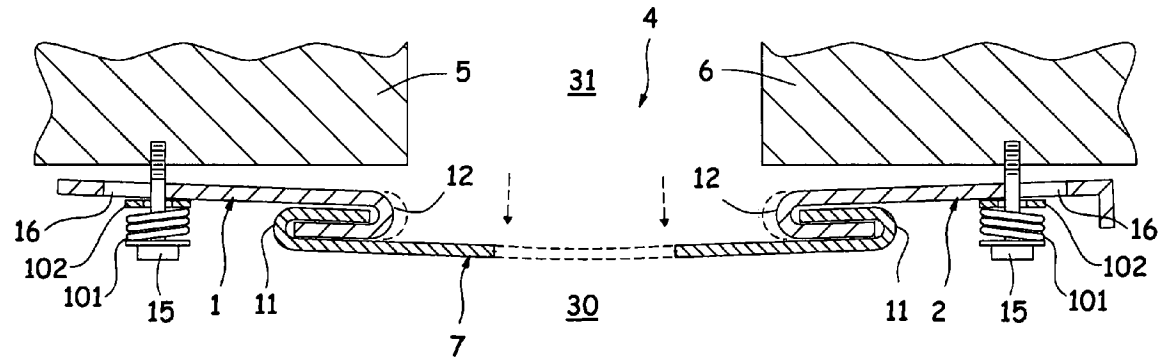
FIG. 3 is the sectional view of FIG. 2 with the curtain displaced away from the plane of the opening by an external force in the direction of the arrows.

With no external forces applied to the apparatus, the first track 1 abuts the first frame member 5 and the second track 2 abuts the second frame member 6. As best shown in FIGS. 2–3, both tracks 1, 2 are on the same side of their respective frames 5, 6, referred to as the track side 30 of the apparatus 10. The opposite side of the apparatus 10 is the non-track side 31. As best shown in FIG. 3, if an external force is applied originating from the non-track side 31, then the edges of the track 12 are not only able to slide inwardly towards the opening 4, but are also able to separate from the frame and move in the direction of the force. This movement allows even less stress to be borne by the curtain 7 and thus less chance that the curtain 7 will fail. Preferably, the tracks 1, 2 are on the inside of the building whose door or windows are sought to be covered by the curtain 7 of the present invention, thus lessening the opportunity for the apparatus 10 to be vandalized or disabled by individuals outside of the building. In this design, external forces such as wind would always originate from the non-track side 31. While the apparatus is still able to withstand forces originating from the track side 30, the ability of the track edges 12 to separate from the frame members 5, 6 allows the apparatus to withstand even greater forces originating from the non-track side 31. So that the track edges 12 may separate from the frame members 5, 6, the connecting member 15 is preferably a bolt where the head of the bolt prevents the tracks 1, 2 from completely detaching from the frame members 5, 6, but is not completely tightened to maintain the tracks 1, 2 flush with the frame members 5, 6, thereby allowing the tracks 1, 2 to move in the plane perpendicular to the plane of the opening 4. While such positioning of the connecting member 15 allows the track edges 12 to separate from the frame members 5, 6 upon the application of an external force, it is preferable that, in the absence of such a force, the track edges 12 abut the frame members 5, 6. Thus, as best shown in FIGS. 2–3, a compression spring 101 and a washer 102 are preferably located between the head of each connecting member 15 and its corresponding tracks 1, 2. The tension of the compression springs 101 are preferably weak enough to permit the track edges 12 to separate from the frame members 5, 6 upon the application to the apparatus 10 of an external force, yet strong enough to urge the track edges 12 to return to their original positions abutting the frame members 5, 6 upon the termination of such external force.

Figure 4:
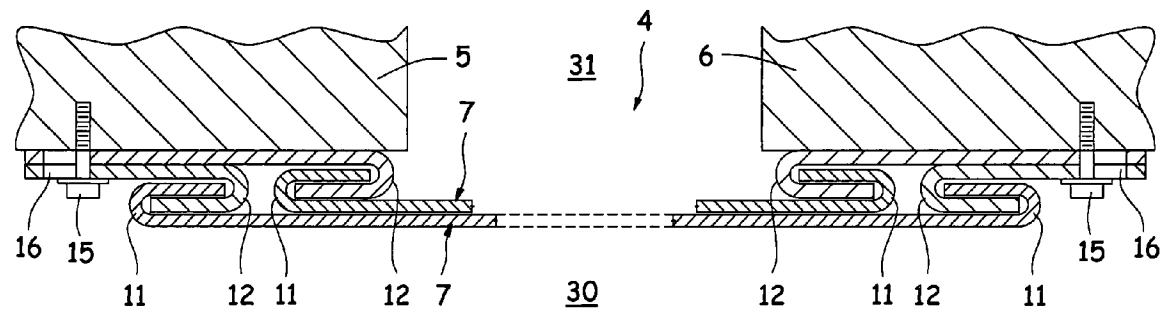
FIG. 4 is a sectional view of an alternate embodiment of the present invention comprising tracks on each side of the opening designed for holding two curtains.

In an alternate embodiment shown in FIG. 4, the present invention has a track on both the first frame 5 and the second frame 6, wherein each track has at least two slightly offset substantially U-shaped track edges 12 for receiving the edges of a plurality of curtains 7. Consequently, this embodiment allows for at least two curtains 7 to be pulled across the same opening 4. Most preferably, the curtains 7 in this embodiment would be made of different materials, such as where one curtain 7 is made of mesh to allow some visibility and the other curtain 7 is opaque. Since the curtains 7 are on different track edges 12, this embodiment allows the user to close either curtain 7, for example the mesh or opaque curtain 7 as he or she desires.

Figure 5:
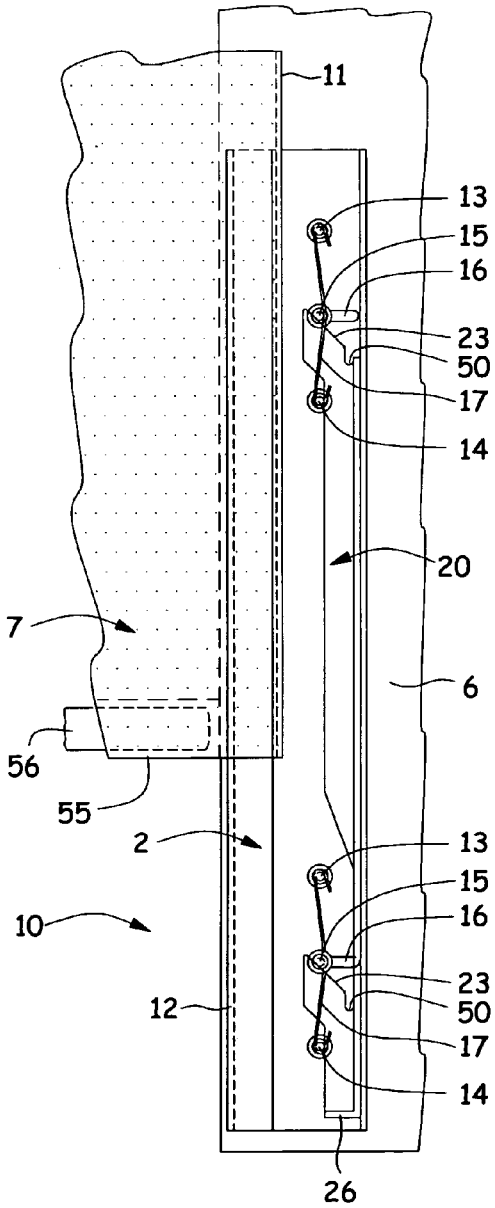
FIG. 5 is a detailed view of an alternate embodiment of the present invention showing a cam mechanism disengaged from the track to keep the curtain taut.
Figure 6:
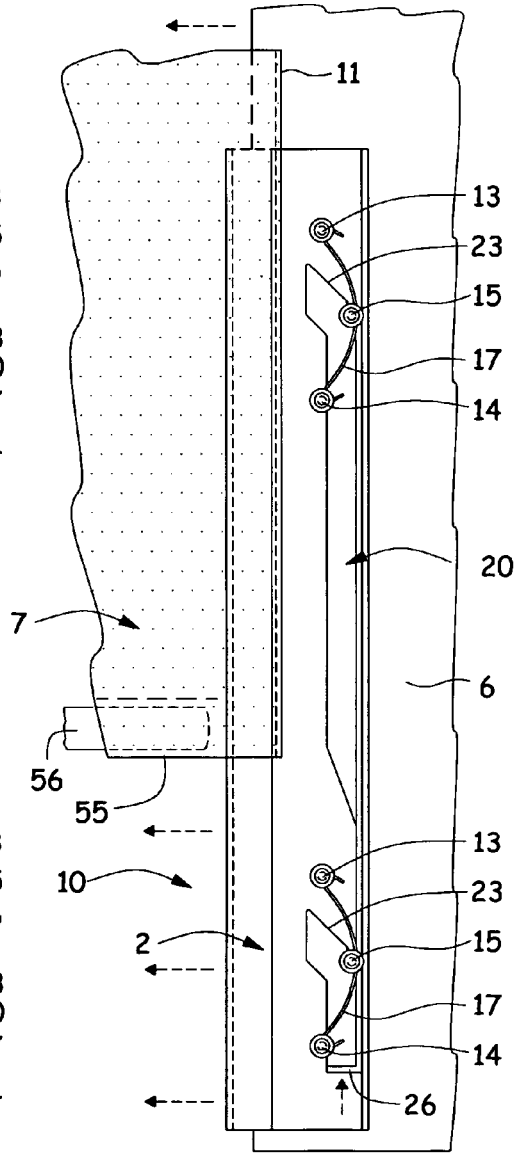
FIG. 6 is a detailed view of the embodiment of FIG. 5 showing the cam mechanism engaging the track to release tension from the curtain.
Figure 7:
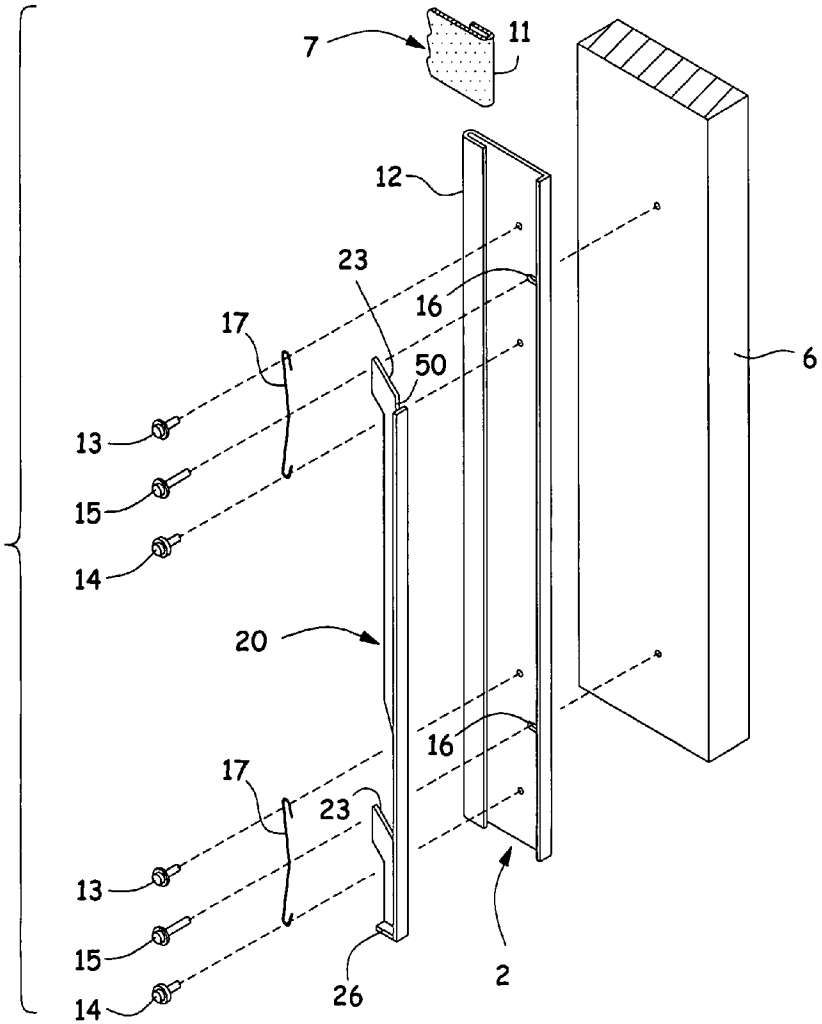
FIG. 7 is an exploded perspective view of the embodiment of FIG. 5.

In the embodiment of the invention shown in FIGS. 5–7, the apparatus 10 has a cam plate 20. While the apparatus 10 could have a cam plate 20 on each track 1, 2 of the apparatus 10, the cam plate 20 is preferably on only one track of the apparatus 10, the description herein showing the cam plate mounted adjacent track 2. The cam plate 20 abuts at least one fixed member, in this case connecting member 15 performs the function of the fixed member, and at least one mobile member, in this case fixed post 14 performs the function of the mobile member. The fixed member 15 is attached to the frame member 6 and the mobile member 14 is attached to the track 2. The cam plate 20 has a diagonal cam surface 23 in abutment with fixed member 15.

When the cam plate 20 is activated by being urged along the track 2, the cam surface 23 engages the fixed member 15, thereby urging the cam plate 20 towards the opening 4. Since the cam plate 20 abuts mobile member 14, the urging of the cam plate 20 towards the opening 4 also causes the mobile member 14 to be urged towards the opening 4. Since the mobile member 14 is attached to the track 2, the result of the activation of the cam plate 20 is that the track 2 is urged toward the opening 4. The urging of the track 2 towards the opening 4 decreases tension on the curtain 7. Consequently, the curtain 7 is less taut and is easier to slide open or closed when the cam plate 20 has been engaged. While the cam plate 20 may be engaged through the manual manipulation of a lever 26, this embodiment may also be practiced by using an automated device where, for example, the cam plate 20 is activated while the curtain 7 is being opened or closed. Once the curtain 7 reaches a predetermined setting, a sensor detects this positioning and the cam plate 20 is disengaged and the curtain 7 is pulled taut. The cam plate 20 preferably has a securing notch 50 adjacent to the cam surface 23. When the cam plate 20 is activated by being urged along the track 2, cam surface 23 slides along fixed member 15 until fixed member 15 is positioned within the securing notch 50, best shown in FIG. 5, thereby securing the cam plate 20 as shown in FIG. 6.

Figure 8:
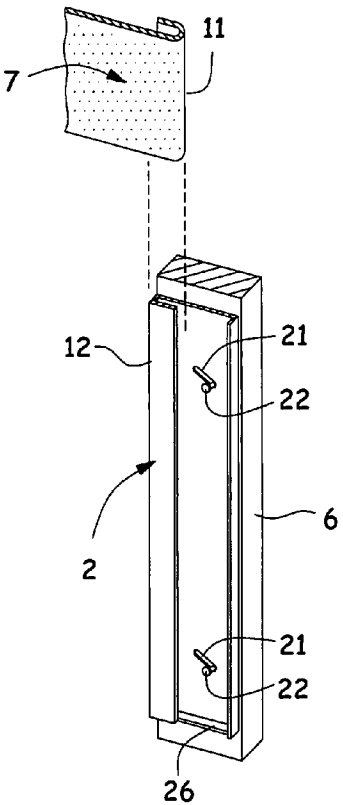
FIG. 8 is a perspective view of an alternate track comprising a diagonally-shaped slot.

While the preferred embodiment accomplishes the aforementioned camming action through a track 2 having an abutting cam plate 20, another embodiment shown in FIG. 8 achieves a similar action without the use of a cam plate 20. In this embodiment, the slot 21 is angled upwardly and inwardly towards the opening 4. While such features may be present, this embodiment does not require a spring assembly 8. This embodiment requires at least one fixed member 22 located within the slot 21. The diagonally-shaped slot 21 described above creates the cam surface 23 described in other embodiments of this invention. A lower shelf 26 is formed on the bottom of the track 2 and is preferably substantially perpendicular to the track 2. Using this construct, the track 2 may be urged upwardly and inwardly towards the opening 4, causing the curtain 7 to be loosened while it is urged in either direction along the track. When the curtain 7 is lowered, the leading edge 55 will engage shelf 26 and force shelf 26 in a downward direction. Since the shelf 26 is connected to the track 2, the track 2 is thus urged downwardly and outwardly from the opening 4, thus tensioning the curtain 7.

Figure 12:
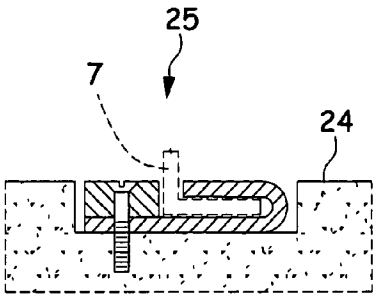
FIG. 12 is a sectional view of the embodiment of FIG. 11 taken along line 12—12 of FIG. 11.
Figure 13:
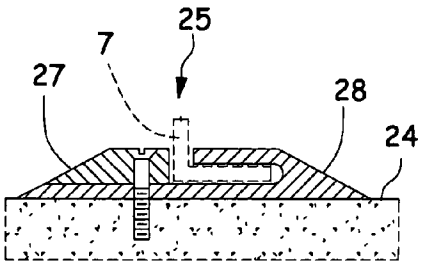
FIG. 13 is a sectional view of an alternate embodiment of the invention of FIG. 1, comprising sloped floor tracks above the floor plane.
Figure 11:
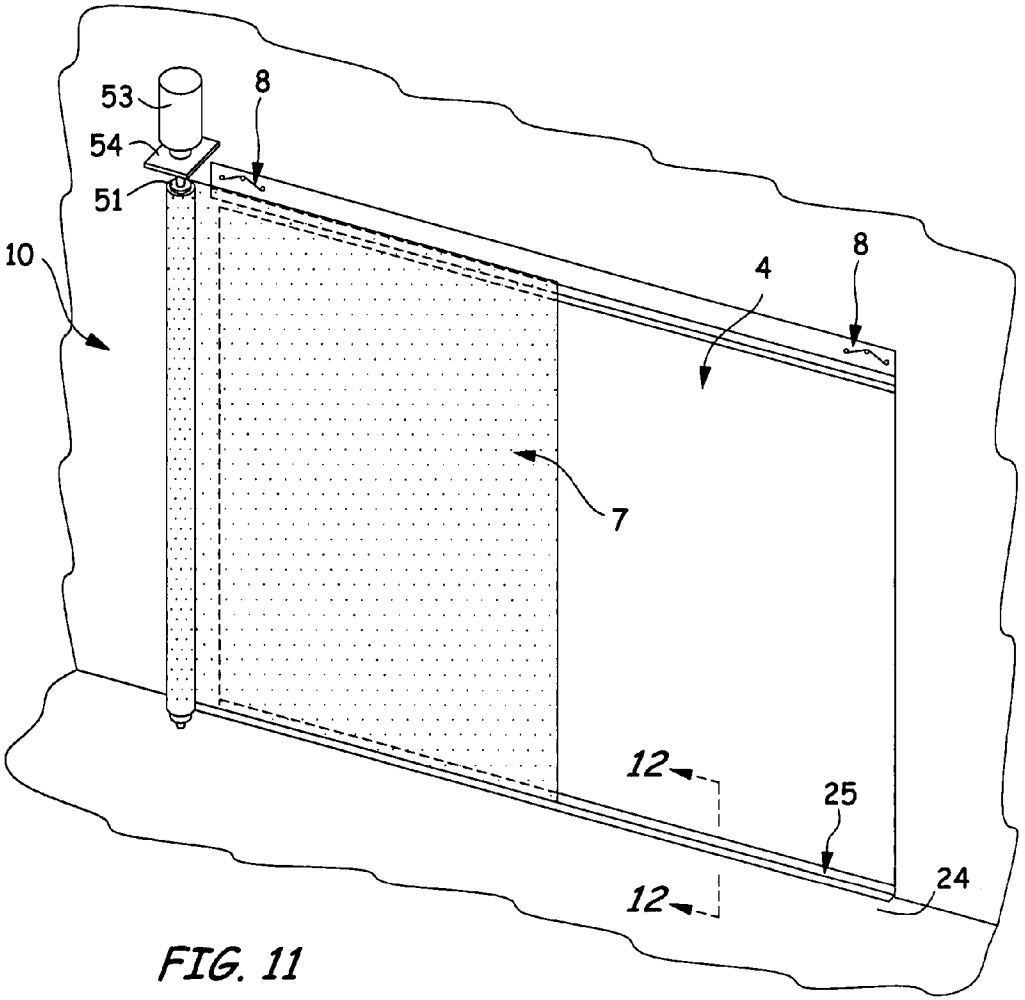
FIG. 11 is a perspective view of an alternate embodiment of the present invention designed for horizontal movement of the curtain across a door frame.

While the most common embodiment of the invention is where the curtain 7 is urged upwardly and downwardly over an opening 4 such as a door or window, FIGS. 11–13 show alternate embodiments where the curtain 7 is urged sideways over an opening 4 such as a patio door. In these embodiments, the features are substantially the same, but rotated ninety degrees. For example, the first 1 and second tracks 2 are upper and lower tracks rather than left and right tracks as in the most common embodiment. However, the lower track will be referred to as the floor track 25 and the lower frame member as the floor frame member 24. The first embodiment of this design, as shown in FIG. 12, has a floor track 25 below the plane separating the floor frame member 24 from the opening 4. The second embodiment of this design, as shown in FIG. 13, has a floor track 25 mounted on top of the floor frame 24. In this embodiment, the floor track 25 has a ramped front end 27 and back end 28. The upper surface of the floor track 25 is substantially horizontal. The angle of the ramped front end 27 and back end 28 is preferably less than or equal to 45°, more preferably less than or equal to 35°, and even more preferably less than or equal to 25°. This allows the opening 4 to be traversed with reduced risk of serious injury from tripping over the floor track 25 due to the gentle sloping nature of the floor track 25.

It is to be understood that the forms of the invention shown and described are preferred embodiments thereof and that various changes and modifications may be made therein without departing from the spirit of the invention or scope as defined in the following claims.

The invention claimed is:

1. A curtain assembly for covering an opening, comprising:

a. an elongated curtain having a first end mounted at a first end of the opening, an opposing second end that is moveable between the first end of the opening and an opposing second end of the opening, and opposing lateral sides slidably attached to opposing sides of the opening;

b. a track on each of the opposing sides of the opening, wherein each track has a securing member for securely engaging an edge of a lateral side of said curtain, wherein at least one track is slidably mounted to a side of the opening such that said slidably mounted track can slide toward the opening to decrease tension on said curtain or slide away from the opening to increase tension on said curtain;

c. a connecting member fixedly attached to the side of the opening and extending through an elongated slot formed in said slidably mounted track, wherein said connecting member holds said slidably mounted track adjacent the side of the opening while allowing said slidably mounted track to slide toward the opening to decrease tension on said curtain or to slide away from the opening to increase tension on said curtain; and d. a spring assembly attached to said slidably mounted track, wherein said spring assembly comprises a spring that engages said connecting member to bias an end of said elongated slot in closest proximity to said opening toward said connecting member such that tension is increased on said curtain.

2. A curtain assembly according to claim 1, wherein said first end of said curtain is mounted for rotation about a roller, wherein said roller can be rotated to either wind or unwind said curtain about said roller, thereby allowing said second end of said curtain to be moved between the first end of the opening and the second end of the opening.

3. A curtain assembly according to claim 1, wherein said securing member comprises a substantially U-shaped edge facing away from the opening for receiving a substantially U-shaped edge of said curtain facing toward the opening.

4. A curtain assembly according to claim 1, wherein said securing member comprises an elongated rod for engaging an elongated channel formed along said edge of said lateral side of said curtain.

5. A curtain assembly according to claim 1, wherein said slidably mounted track is mounted to the side of the opening such that said track can move in a direction substantially perpendicular to the plane of the opening to decrease tension on said curtain and wherein said assembly further comprises a spring member mounted to said connecting member for urging said track against the side of the opening.

6. A curtain assembly according to claim 1, wherein a second track is below a horizontal face of the opening and said securing member on said second track comprises a substantially U-shaped member for receiving said edge of said lateral side of said curtain.

7. A curtain assembly according to claim 1, wherein a second track comprises a ramp on each side of the opening and said securing member on said second track comprises a substantially U-shaped member for receiving said edge of said lateral side of said curtain.

8. The curtain assembly according to claim 7, wherein each ramp has an angle less than or equal to forty-five degrees.

9. The curtain assembly according to claim 7, wherein each ramp has an angle less than or equal to twenty-five degrees.

10. A curtain assembly for covering an opening, comprising:

a. an elongated curtain having a first end mounted at a first end of the opening, an opposing second end that is moveable between the first end of the opening and an opposing second end of the opening, and opposing lateral sides slidably attached to opposing sides of the opening;

b. a track on each of the opposing sides of the opening, wherein each track has a securing member for securely engaging an edge of a lateral side of said curtain, wherein at least one track is slidably mounted to a side of the opening such that said slidably mounted track can slide toward the opening to decrease tension on said curtain or slide away from the opening to increase tension on said curtain;

c. a connecting member fixedly attached to the side of the opening and extending through an elongated diagonal slot formed in said slidably mounted track, wherein said connecting member holds said slidably mounted track adjacent the side of the opening while allowing said slidably mounted track to slide diagonally upward toward the opening to decrease tension on said curtain or to slide diagonally downward away from the opening to increase tension on said curtain; and d. a flange located at a bottom end of said slidably mounted track such that as a leading edge of said second end of said curtain approaches the second end of the opening, said leading edge will engage said flange and thereby urge said slidably mounted track diagonally downward away from the opening to increase tension on said curtain.

11. A curtain assembly for covering an opening, comprising:

a. an elongated curtain having a first end mounted at a first end of the opening, an opposing second end that is moveable between the first end of the opening and an opposing second end of the opening, and opposing lateral sides slidably attached to opposing sides of the opening;

b. a track on each of the opposing sides of the opening, wherein each track has a securing member for securely engaging an edge of a lateral side of said curtain, wherein at least one track is slidably mounted to a side of the opening such that said slidably mounted track can slide toward the opening to decrease tension on said curtain or slide away from the opening to increase tension on said curtain;

c. a connecting member fixedly attached to the side of the opening and extending through an elongated slot formed in said slidably mounted track, wherein said connecting member holds said slidably mounted track adjacent the side of the opening while allowing said slidably mounted track to slide toward the opening to decrease tension on said curtain or to slide away from the opening to increase tension on said curtain; and d. a cam plate mounted on said slidably mounted track and having a cam surface for engaging said connecting member, wherein said cam surface is operable to engage said connecting member and thereby urge said slidably mounted track to slide toward the opening to decrease tension on said curtain.

12. A curtain assembly according to claim 11, wherein said cam plate includes a notch adjacent said cam surface for receiving said connecting member and thereby releasably securing said slidably mounted track in a position such that said tension on said curtain is decreased.

13. A curtain assembly for covering an opening, comprising:

a. an elongated curtain having a first end mounted at a first end of the opening, an opposing second end that is moveable between the first end of the opening and an opposing second end of the opening, and opposing lateral sides slidably attached to opposing sides of the opening; and b. a track on each of the opposing sides of the opening, wherein each track has a securing member for securely engaging an edge of a lateral side of said curtain continuously along the length of the lateral side between the first and second ends of the opening to prevent movement of said lateral side toward the opening relative to said track, wherein at least one track is mounted to a side of the opening such that said track can move in a direction substantially perpendicular to the plane of the opening to decrease tension on said curtain.

14. A curtain assembly according to claim 13, further comprising means for biasing said at least one track towards the side of the opening.

15. A curtain assembly for covering an opening, comprising:

a. an elongated curtain having a first end mounted at a first end of the opening, an opposing second end that is moveable between the first end of the opening and an opposing second end of the opening, and opposing lateral sides slidably attached to opposing sides of the opening;

b. a track on each of the opposing sides of the opening, wherein each track has a securing member for securely engaging an edge of a lateral side of said curtain, wherein at least one track is mounted to a side of the opening such that said track can move in a direction substantially perpendicular to the plane of the opening to decrease tension on said curtain;

c. a connecting member having a first end fixedly attached to the side of the opening, an intermediate portion extending through a hole formed in said at least one track, and a second end having means for holding said at least one track adjacent the side of the opening; and d. a spring member mounted to said intermediate portion between said at least one track and said holding means, wherein said spring member biases said at least one track against the side of the opening.

* * * * *